United States Patent [19]

Duel

[11] 3,962,973

[45] June 15, 1976

[54] TIME DELAY CONTROL MECHANISM

[75] Inventor: Don M. Duel, Phoenix, Ariz.

[73] Assignee: Motorola, Inc., Chicago, Ill.

[22] Filed: Oct. 29, 1974

[21] Appl. No.: 518,325

[52] U.S. Cl. ..... 102/80; 102/70 R

[51] Int. Cl.[2] ..... F42C 15/26

[58] Field of Search ..... 102/79, 80, 82, 76 R, 102/70 R

[56] References Cited

UNITED STATES PATENTS

| | | | |
|---|---|---|---|
| 859,590 | 7/1907 | Ziegenfuss | 102/80 |
| 2,455,620 | 12/1948 | Sreb | 102/79 X |
| 2,458,467 | 1/1949 | Dike | 102/80 X |
| 2,977,883 | 4/1961 | Czajkowski | 102/79 |
| 3,012,505 | 12/1961 | Linn | 102/79 X |
| 3,073,241 | 1/1963 | Rosselet | 102/79 |
| 3,075,465 | 1/1963 | Craig | 102/80 X |
| 3,640,225 | 2/1972 | Carlson et al. | 102/79 |

FOREIGN PATENTS OR APPLICATIONS

| | | | |
|---|---|---|---|
| 1,162,138 | 9/1958 | France | 102/79 |
| 174,829 | 7/1905 | Germany | 102/80 |
| 17,795 | 5/1906 | United Kingdom | 102/80 |

*Primary Examiner*—David H. Brown

*Attorney, Agent, or Firm*—Vince J. Rauner; Sang Ki Lee

[57] ABSTRACT

A time delay mechanism for projectiles utilizing angular acceleration to control the flow of a granular material. The angle of the path of the flow with respect to the radius vector is used to differentiate between constant angular velocity and angular acceleration. There are at least three modes in which this capability can be utilized in a projectile: (1) inert material may be moved from an initial location to provide "unlatching" action, (2) active or high energy material may be moved from one location to a second location for utilization at the second location, or (3) inert material may be moved from a location such as a firing chamber where it provides "safing" action and, simultaneously, active material may be moved into the chamber.

7 Claims, 9 Drawing Figures

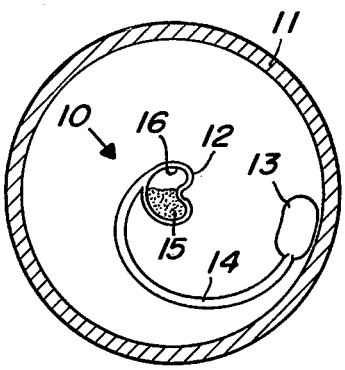
FIG. 1A
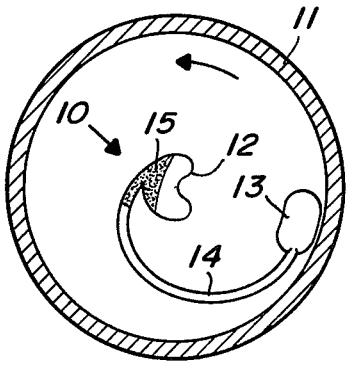
FIG. 1B
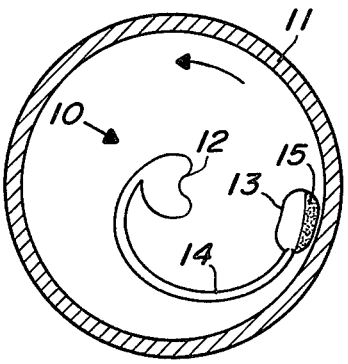
FIG. 1C
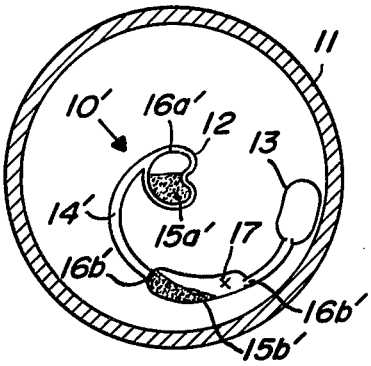
FIG. 2A
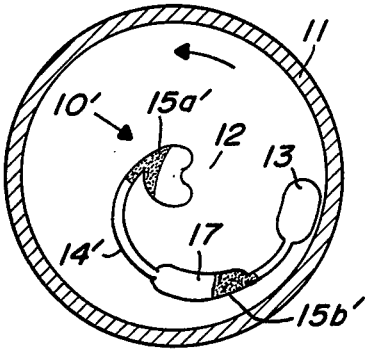
FIG. 2B
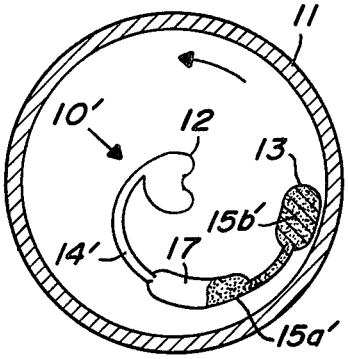
FIG. 2C
FIG. 4
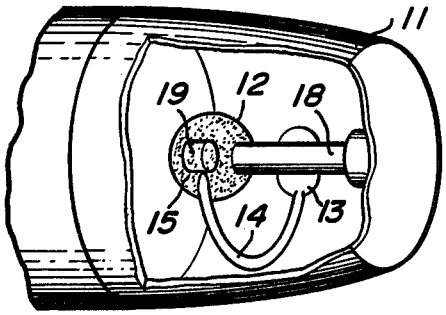
FIG. 3B
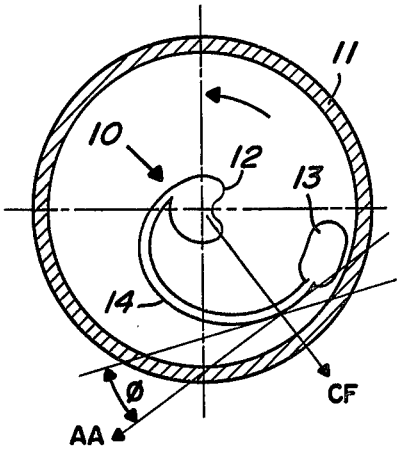
FIG. 3A
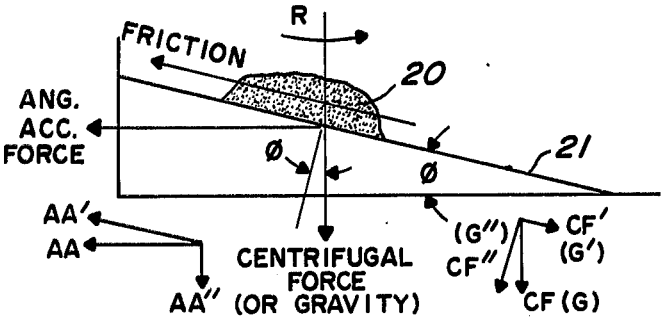

TIME DELAY CONTROL MECHANISM

BACKGROUND OF THE INVENTION

1. Field of the Invention

The present invention relates to "safing and arming" devices for projectiles and more particularly to devices utilizing the centrifugal force of a spinning projectile for some part of the safing and arming function.

2. Prior Art

The two primary requirements in the handling and use of projectiles are the prevention of unwanted arming and certainty of arming at the appropriate time. Many methods have been devised to utilize the flow of a liquid or granular material to perform a part of this safing and arming function. Most of these devices use setback force to enable the flow of the liquid or granular material. The spinning action of the projectile, caused by the rifling of the bore of the weapon, initiates the flow of the material which after some interval of time will have progressed to a point where arming can take place. This means that the flow of the material begins at the start of angular acceleration. However, it would be more desirable to prevent the flow of the material until the material is no longer acted upon by the acceleration, thus allowing an extra safety feature for the personnel using such a projectile.

SUMMARY OF THE INVENTION

It is, therefore, a general object of the present invention to provide an improved safing and arming mechanism for projectiles which spin in flight.

It is a specific object of the invention to initiate the enabling of arming at that point in time when angular acceleration of the projectile ceases and angular velocity becomes constant.

In accordance with the present invention, the aforementioned and other objects are achieved by providing a safing and arming device of a spinned projectile utilizing centrifugal force for operation having a time delay apparatus of a novel design. Illustratively, one embodiment of such a time delay apparatus comprises a first chamber disposed substantially at the central axis of the projectile, an active material initially contained in the first chamber, a second chamber located away from the central axis; and a channel connecting the first chamber to the second chamber wherein the channel is adapted to retain the active material in the first chamber when it is acted upon by the centrifugal force and the angular acceleration and to allow the active material to move to the second chamber when the material is no longer acted upon by the force of the angular acceleration.

According to another aspect of the present invention the aforementioned and other objects are achieved by disposing the channel through which the material flows in such a way that the force of the angular acceleration acts upon the material in opposition to the centrifugal force. More specifically, the surface of the channel upon which the material slides must have an angle, relative to the radius vector, greater than the angle of repose for the given material and the given centrifugal force. Thus the material will flow down the surface of the channel when acted upon by centrifugal force alone but will be held back when the force of angular acceleration forces is present. Since angular acceleration effectively ceases when the projectile is free of the barrel, arming is essentially prohibited while the projectile is still in the barrel. This feature may be utilized in two ways: to remove an inert material from a position where it blocks a firing mechanism from arming, or to move an active or energetic material to a position where it can participate in a burst function at the desired time. A combination of these two possibilities would utilize an inert material in a firing chamber for safety during storage and firing, then removing the inert material and introducing active or energetic material after firing and before burst function is desired. Another embodiment of this invention would utilize a conductive material which would open an electrical circuit in the chamber it leaves or complete one in the chamber to which it is moved. Since there are many safing and arming devices in the prior art which utilize the flow of a liquid or granular material under centrifugal force, and many of them could be made safer by incorporating the principle of the present invention, only that part of the projectile is shown in the figures which is necessary to establish the orientation of the parts of the invention within the projectile.

BRIEF DESCRIPTION OF THE DRAWINGS

FIGS. 1A, 1B and 1C are cross sections of a projectile in the plane perpendicular to its axis of rotation and through the center line of the instant device. This drawing covers two embodiments of the device.

FIGS. 2A, 2B and 2C are a sections of the projectile as in FIG. 1, that cover an embodiment wherein two different materials are to be moved. FIGS. 1A, 1B, 1C, 2A, 2B and 2C indicate the orientation of the two materials.

FIGS. 3A and 3B show vector diagrams of forces which illustrate the principle of the present invention.

FIG. 4 is a partial cut away perspective view of a projectile showing the orientation of the device.

DESCRIPTION OF THE PREFERRED EMBODIMENTS

FIGS. 1A, 1B and 1C show two embodiments, which will be described in sequence. In FIG. 1A of the first embodiment, a safing and arming delay device 10 is contained within a housing 11 of a projectile (not shown) which is at rest. The delay device 10 consists of four essential parts: an inner chamber 12, an outer chamber 13, a channel 14 connecting the inner chamber and the outer chamber, and an inert material 15. The inner chamber 12 is located at or near the axis of the projectile and initially contains the material 15 which may be liquid or granular in form. The inert material is held in place until firing time by a form of barrier of a conventional design, indicated here as a ring 16. This ring is removed from its barrier position by setback force, and the material 15 attempts to leave the chamber 12 as shown in FIG. 1B. However, FIG. 1B shows the condition of the delay device 10 during angular acceleration when, because of the spiral shape of the channel 14, the effect of the force exerted on the material by angular acceleration is sufficient to counteract the effect of centrifugal force and the material 15 is prevented from moving down the channel 14. FIG. 1C illustrates the condition of the delay device 10 after angular acceleration has ceased. Centrifugal force has caused the material 15 to slide down the channel 14 to the outer chamber 13. The removal of the material 15 from the inner chamber 12 now allows some form of arming mechanism (not shown) to be enabled.

FIG. 1 also shows a second embodiment wherein the same action takes place but with the following differences: the material 15 is an active or energetic material, there is no arming mechanism related to the inner chamber 12, and the outer chamber 13 is an element in the burst sequence structure (not shown in its entirety).

FIGS. 2A, 2B and 2C illustrate a third embodiment which incorporates some features of the first two. Parts identical to those of FIG. 1 have the same reference numbers. Analogous parts have the same numbers primed. Again are shown the housing 11 of the projectile (not shown), the inner chamber 12 and the outer chamber 13. Connecting the two chambers is a channel 14' having at some point in its mid-section a center chamber 17. The center chamber is an element in the burst sequence structure (not shown in its entirety). In FIG. 2A, the projectile is at rest and an active material 15*a'* is retained within the inner chamber 12 by a barrier 16*a'*. Contained within the center chamber 17 by barriers 16*b'* is an inert material 15*b'*. Again the barriers are removed by setback force but the materials are restrained from moving in response to centrifugal force by the force of the angular acceleration which acts in opposition. This condition is shown in FIG. 2B. In FIG. 2C, angular acceleration has ceased and the inert material 15*b'* has moved from the center chamber 17 to the outer chamber 13. The active material 15*a'* has moved from the inner chamber 12 to the center chamber. The center chamber is preferably designed so that the active point (designated by an "*x*" in FIG. 2*a*) is occupied by the inert material as long as possible.

FIG. 3A shows a vector diagram of forces involved in the operation of the present delay mechanism in the safing and arming device. In FIG. 3A a granular material 20 rests on an incline surface 21. If the surface 21 were at rest, and gravity and friction (including surface friction and the internal "friction" of the granular material) were the only two forces acting upon the material 20, the material would begin to "flow" down the surface when angle $\phi$ was large enough so that the component of gravity parallel to the surface (G') was greater than the combined frictional forces. When $\phi$ becomes 90°, the material would almost certainly fall along the surface. If the surface 21 were revolving about some center point on R at a constant speed the same factors would apply except that gravity is generally replaced by centrifugal force (CF). In this case, if $\phi$ becomes 90° very little centrifugal force would be required to cause movement of the material. However, if the surface 21 were accelerating angularly in the direction indicated, another force is involved, namely, a force due to the angular acceleration (AA). Now the frictional forces parallel to the surface 21, which act to retard the movement of the material down the inclined surface, are aided by that component of the force due to angular acceleration which is parallel to the surface (AA'). There is then a range of values of $\phi$ for which the material 20 would not flow when angular acceleration is present, but would flow when angular velocity is constant.

In FIG. 3B, the forces (CF) and (AA) are shown as acting in the environment of the present invention.

FIG. 4 shows a perspective view of a portion of a projectile, cut away to show the orientation of the device relative to a firing pin or striker 18 and primer capsule or detonator 19.

The foregoing description of the embodiment of the invention is by way of example only and not intended to limit the scope of the appended claims. No attempt has been made to illustrate all possible embodiments of the invention, but rather only to illustrate its principles and the best manner presently known to practice it. Therefore, such other forms of the invention as may occur to one skilled in this art upon reading the foregoing specification are also within the spirit and scope of the invention, and is intended that this invention include all modifications and equivalents which fall within the scope of the appended claims.

What is claimed is:

1. A time delay mechanism in a safing and arming device of a spin-projectile, comprising:

first chamber disposed substantially at the center axis of said projectile, second chamber disposed at a greater radius than said first chamber, fluent material contained in said first chamber for rendering said spin-projectile safe, means for retaining said fluent material in said first chamber, said retaining means removable upon application of a set back force applied to the projectile, and a channel connecting said first chamber to said second chamber, said channel is so formed as to retain said fluent material when acted upon by both the centrifugal force and the force of angular acceleration of said spin-projectile in motion and to allow said fluent material to move to said second chamber when the force of said angular acceleration is removed from said fluent material for arming said spin-projectile.

2. The mechanism according to claim 1, wherein said fluent material is an active material.

3. The mechanism according to claim 1, wherein said fluent material is an inert material.

4. The mechanism according to claim 1, said channel forms a spiral path between said first chamber and said second chamber.

5. A time delay mechanism in a safing and arming device of a spin-projectile, comprising:

first chamber disposed substantially at the center axis of said projectile, second chamber disposed at a greater radius of said first chamber, third chamber disposed intermediate between said first chamber and said second chamber, first fluent material disposed in said first chamber, second fluent material disposed in said third chamber, means for retaining said first fluent material in said first chamber and said second fluent material in said third chamber, said retaining means being removable upon application of a setback force applied to the projectile, first channel connecting said first chamber to said third chamber, second channel connecting said third chamber to said second chamber, wherein said first and second channels are so formed as to retain said first and said second fluent materials when the centrifugal force and the force of angular acceleration are exerted thereon by said projectile in motion and to allow the movement of said first fluent material to said third chamber and said second fluent material to from said third chamber to said second chamber respectively, when the force of said angular acceleration is removed from said first fluent material and said second fluent material.

6. The mechanism according to claim 5, wherein said first and said second channels are disposed along a spiral path from said first chamber to said third chamber and thence to said second chamber.

7. The mechanism according to claim 5, wherein said first fluent material is an active material and said second fluent material is an inert material.

* * * * *